US006026645A

United States Patent [19]

Stokes et al.

[11] Patent Number: 6,026,645

[45] Date of Patent: Feb. 22, 2000

[54] FUEL/AIR MIXING DISKS FOR DRY LOW-$NO_X$ COMBUSTORS

[75] Inventors: Mitchell O. Stokes; William Richard Ryan, both of Orlando, Fla.

[73] Assignee: Siemens Westinghouse Power Corporation, Orlando, Fla.

[21] Appl. No.: 09/039,643

[22] Filed: Mar. 16, 1998

[51] Int. Cl.[7] ..... F02G 1/00

[52] U.S. Cl. ..... 60/737; 60/740; 60/746; 239/419.5; 239/462

[58] Field of Search ..... 60/732, 733, 737, 60/740, 746, 748; 239/419.5, 462, 553.3, 590.3

[56] References Cited

U.S. PATENT DOCUMENTS

| | | | |
|---|---|---|---|
| 2,385,833 | 10/1945 | Nahigyan | 60/746 |
| 2,488,911 | 11/1949 | Hepburn et al. | 60/746 |
| 3,946,553 | 3/1976 | Roberts et al. | 60/737 |
| 4,107,918 | 8/1978 | Andrew et al. | 60/39.71 |
| 4,587,809 | 5/1986 | Ohmori et al. | 60/737 |
| 5,161,379 | 11/1992 | Jones et al. . | |
| 5,197,290 | 3/1993 | Lee et al. | 60/748 |
| 5,437,158 | 8/1995 | Fric . | |
| 5,611,684 | 3/1997 | Speilman | 60/737 |
| 5,797,268 | 8/1998 | Ryan . | |

FOREIGN PATENT DOCUMENTS

| | | |
|---|---|---|
| 0 526 152 A1 | 2/1993 | European Pat. Off. . |
| 0 529 310 A1 | 3/1993 | European Pat. Off. . |
| 0 594 127 A1 | 4/1994 | European Pat. Off. . |
| 0 691 521 A2 | 1/1996 | European Pat. Off. . |
| 0 711 957 A2 | 5/1996 | European Pat. Off. . |

*Primary Examiner*—Charles G. Freay

*Attorney, Agent, or Firm*—Eckert Seamans Cherin & Mellott, LLC

[57] ABSTRACT

A fuel mixer for a gas turbine combustor is provided. The fuel mixer has a substantially cylindrical body with a flared end and a tapered end. The flared end is adapted for receiving compressed air and for channeling the compressed air into the fuel mixer. The fuel mixer has a fuel/air mixing disk disposed within the body proximate the flared end. A disk axis of the fuel/air mixing disk is substantially parallel to the axis of the fuel mixer body. The fuel/air mixing disk has a plurality of holes parallel to the disk axis. The fuel/air mixer reduces $NO_x$ and CO emissions in a gas turbine combustor by providing more evenly distributed fuel/air mixtures without increasing the risk of flame holding or flashback.

7 Claims, 4 Drawing Sheets

FUEL/AIR MIXING DISKS FOR DRY LOW-$NO_X$ COMBUSTORS

FIELD OF THE INVENTION

The present invention relates to combustors for gas turbine engines. More specifically, the present invention relates to fuel/air mixing disks that reduce nitrogen oxide and carbon monoxide emissions produced by lean premix combustors.

BACKGROUND OF THE INVENTION

Gas turbines are known to comprise the following elements: a compressor for compressing air; a combustor for producing a hot gas by burning fuel in the presence of the compressed air produced by the compressor; and a turbine for expanding the hot gas produced by the combustor. Gas turbines are known to emit undesirable oxides of nitrogen ($NO_x$) and carbon monoxide (CO). One factor known to affect $NO_x$ emission is combustion temperature. The amount of $NO_x$ emitted is reduced as the combustion temperature is lowered. However, higher combustion temperatures are desirable to obtain higher efficiency and CO oxidation.

Two-stage combustion systems have been developed that provide efficient combustion and reduced $NO_x$ emissions. In a two-stage combustion system, diffusion combustion is performed at the first stage for obtaining ignition and flame stability. Premixed combustion is performed at the second stage to reduce $NO_x$ emissions.

The first stage, referred to hereinafter as the "pilot" stage, is normally a diffusion-type burner and is, therefore, a significant contributor of $NO_x$ emissions even though the percentage of fuel supplied to the pilot is comparatively quite small (often less than 10% of the total fuel supplied to the combustor). The pilot flame has thus been known to limit the amount of $NO_x$ reduction that could be achieved with this type of combustor.

Pending U.S. patent application Ser. No. 08/759,395, assigned to the same assignee hereunder (the '395 application), is incorporated herein by reference and discloses a typical prior art gas turbine combustor 100. As shown in FIG. 1 herein, combustor 100 comprises a nozzle housing 6 having a nozzle housing base 5. A diffusion fuel pilot nozzle 1, having a pilot fuel injection port 4, extends through nozzle housing 6 and is attached to nozzle housing base 5. Main fuel nozzles 2, each having at least one main fuel injection port 3, extend substantially parallel to pilot nozzle 1 through nozzle housing 6 and are attached to nozzle housing base 5. Fuel inlets 16 provide fuel 102 to main fuel nozzles 2. A main combustion zone 9 is formed within a liner 19. A pilot cone 20, having a diverged end 22, projects from the vicinity of pilot fuel injection port 4 of pilot nozzle 1. Diverged end 22 is downstream of main fuel swirlers 8. A pilot flame zone 23 is formed within pilot cone 20 adjacent to main combustion zone 9.

Compressed air 101 from compressor 50 flows between support ribs 7 through main fuel swirlers 8. Each main fuel swirler 8 is substantially parallel to pilot nozzle 1 and adjacent to main combustion zone 9. Within each main fuel swirler 8, a plurality of swirler vanes 80 generate air turbulence upstream of main fuel injection ports 3 to mix compressed air 101 with fuel 102 to form a fuel/air mixture 103. Fuel/air mixture 103 is carried into main combustion zone 9 where it combusts. Compressed air 12 enters pilot flame zone 23 through a set of stationary turning vanes 10 located inside pilot swirler 11. Compressed air 12 mixes with pilot fuel 30 within pilot cone 20 and is carried into pilot flame zone 23 where it combusts.

FIG. 2 shows a detailed view of a prior art fuel swirler 8. As shown in FIG. 2, fuel swirler 8 is substantially cylindrical in shape, having a flared end 81 and a tapered end 82. A plurality of swirler vanes 80 are disposed circumferentially around the inner perimeter 83 of fuel swirler 8 proximate flared end 81. Fuel swirler 8 surrounds main fuel nozzle 2 proximate main fuel injection ports 3. Fuel swirler 8 is positioned with swirler vanes 80 upstream of main fuel injection ports 3 and tapered end 82 adjacent to main combustion zone 9. Flared end 81 is adapted to receive compressed air 101 and channel it into fuel swirler 8. Tapered end 82 is adapted to fit into sleeve 86. Swirler vanes 80 are attached to a hub 87. Hub 87 surrounds main fuel nozzle 2. Fuel swirler 8 is attached to liner 19 via attachments 89 and swirler base 99.

FIG. 3 shows an upstream view of combustor 100. As shown in FIG. 3, pilot nozzle 1 is surrounded by pilot swirler 11. Pilot swirler 11 has a plurality of stationary turning vanes 10. Pilot nozzle 1 is surrounded by a plurality of main fuel nozzles 2. A main fuel swirler 8 surrounds each main fuel nozzle 2. Each main fuel swirler 8 has a plurality of swirler vanes 80. The diverged end 22 of pilot cone 20 forms an annulus 18 with liner 19. Main fuel swirlers 8 are upstream of diverged end 22. Fuel/air mixture 103 flows through annulus 18 (out of the page) into main combustion zone 9 (not shown in FIG. 3).

It is known that gas turbine combustors such as those described in FIG. 1 emit oxides of nitrogen ($NO_x$), carbon monoxide (CO), and other airborne pollutants. While gas turbine combustors such as the combustor disclosed in the '395 application have been developed to reduce these emissions, current environmental concerns demand even greater reductions.

It is known that leaner fuel/air mixtures burn cooler and thus decrease $NO_x$ emissions. One known technique for providing a leaner fuel mixture is to generate turbulence to homogenize the air and fuel as much as possible before combustion to eliminate rich zones which would result in localized hot regions ("hot spots").

Fuel swirlers having swirler vanes such as those described above have been used to generate premix turbulence to create lean fuel/air mixtures. The swirler vanes create an obstruction in the path of the compressed air as it moves through the fuel swirler. This obstruction causes a pressure drop within the fuel swirler. Since the pressure of the fuel/air mixture moving into the main combustion zone directly affects the air-to-fuel ratio (AFR) in the main combustion zone (by affecting the intra-combustor air distribution), a higher pressure drop within the fuel swirler reduces the AFR. While turbulence is necessary to premix fuel and air, if too much turbulence is carried into the main combustion zone, recirculation zones are formed, increasing the risk of flame holding.

Thus, there is a need in the art for a fuel swirler that reduces $NO_x$ and CO emissions from gas turbine combustors by optimizing the amount of premix turbulence generated to provide more evenly distributed fuel/air mixtures without increasing the risk of flame holding or flashback.

Additionally, swirler vanes are generally of a fixed geometry and provide relatively little control over the pressure drop in the fuel swirler. Similarly, a set of swirler vanes which optimizes the AFR for one combustor generally will not be optimal for combustors of other sizes. The costs associated with varying the size of the swirler vanes to optimize pressure drop, or to accommodate different sized combustors is generally quite high.

Thus, there is a need in the art for a fuel swirler that reduces $NO_x$ and CO emissions from gas turbine combustors by providing greater control over the pressure drop within the fuel swirler, while increasing the flexibility and decreasing the costs associated with optimizing the AFR in combustors of different sizes.

SUMMARY OF THE INVENTION

The present invention satisfies these needs in the art by providing a fuel mixer that reduces $NO_x$ and Co emissions in a gas turbine combustor by providing more evenly distributed fuel/air mixtures without increasing the risk of flame holding or flashback.

A fuel mixer of the present invention comprises a substantially cylindrical body having an axis, a flared end, and a tapered end. The flared end is adapted for receiving compressed air and for channeling the compressed air into the fuel mixer. The fuel mixer has a fuel/air mixing disk disposed within the body proximate the flared end. A disk axis of the fuel/air mixing disk is substantially parallel to the axis of the fuel mixer body. The fuel/air mixing disk has a plurality of holes parallel to the disk axis.

A gas turbine combustor of the present invention comprises a nozzle housing adjacent to a main combustion zone, a pilot nozzle, at least one main nozzle extending through the nozzle housing and attached thereto a pilot cone projecting from the vicinity of an injection port of the pilot nozzle, and at least one fuel mixer parallel to the pilot nozzle and adjacent to the main combustion zone. The fuel mixer surrounds the main nozzle and comprises a fuel/air mixing disk as described above.

DETAILED DESCRIPTION OF THE PREFERRED EMBODIMENT

Figure 4:
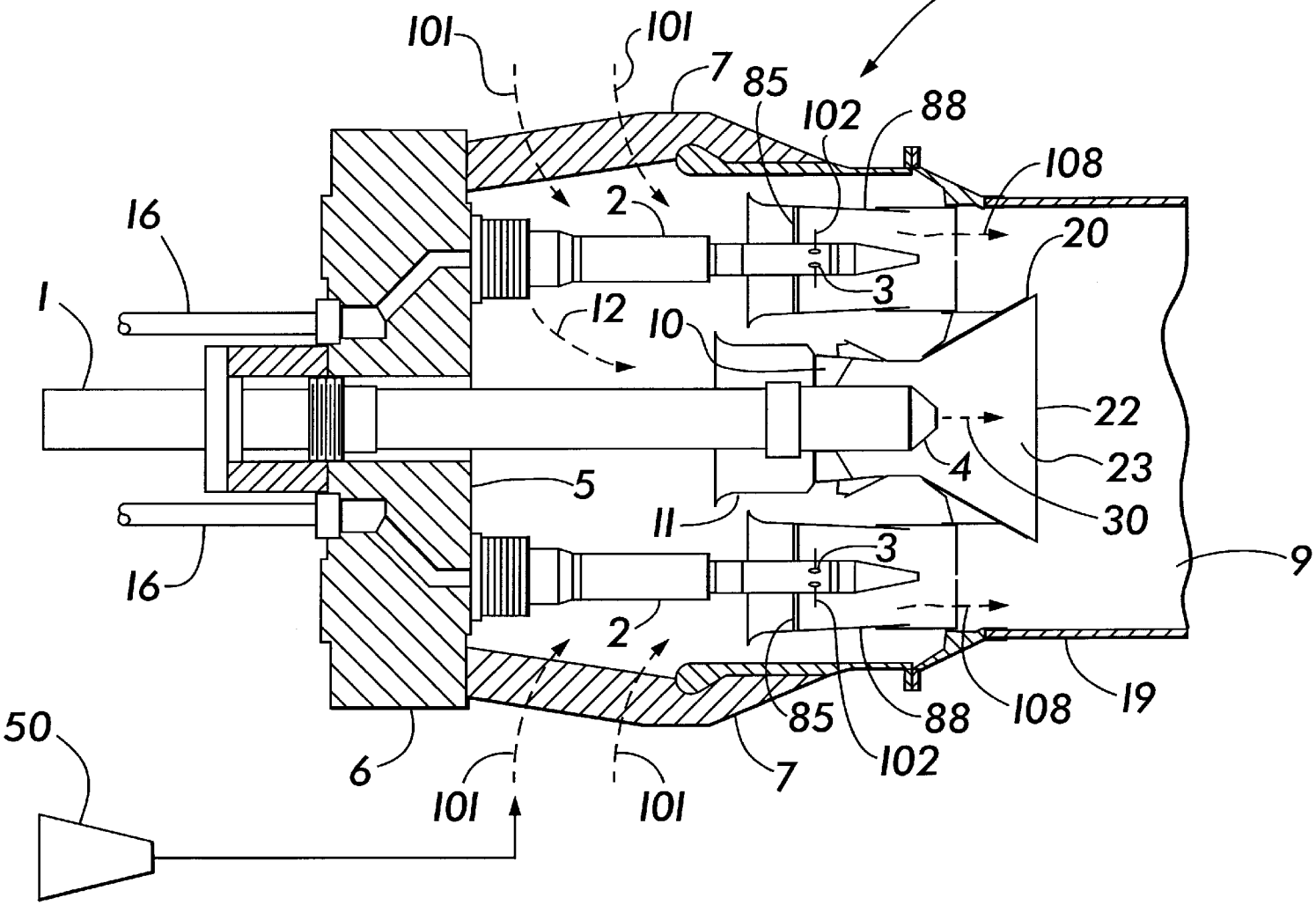
FIG. 4 shows a cross-sectional view of a preferred embodiment of a gas turbine combustor comprising fuel/air mixing disks according to the present invention.

FIG. 4 shows a cross-sectional view of a preferred embodiment of a gas turbine combustor 110 comprising fuel/air mixing disks 85 according to the present invention. As shown in FIG. 4, combustor 110 comprises a nozzle housing 6 having a nozzle housing base 5. A diffusion fuel pilot nozzle 1, having a pilot fuel injection port 4, extends through nozzle housing 6 and is attached to nozzle housing base 5. Main fuel nozzles 2, each having at least one main fuel injection port 3, extend substantially parallel to pilot nozzle 1 through nozzle housing 6 and are attached to nozzle housing base 5. Fuel inlets 16 provide fuel 102 to main fuel nozzles 2. A main combustion zone 9 is formed within a liner 19. A pilot cone 20, having a diverged end 22, projects from the vicinity of pilot fuel injection port 4 of pilot nozzle 1. Diverged end 22 is downstream of main fuel mixers 88. A pilot flame zone 23 is formed within pilot cone 20 adjacent to main combustion zone 9.

Compressed air 101 from compressor 50 flows between support ribs 7 through main fuel mixers 88. Each main fuel mixer 88 is substantially parallel to pilot nozzle 1 and adjacent to main combustion zone 9. Within each main fuel mixer 88, a fuel/air mixing disk 85 generates air turbulence upstream of main fuel injection ports 3 to mix compressed air 101 with fuel 102 to form a fuel/air mixture 108. Fuel/air mixture 108 is carried into main combustion zone 9 where it combusts. As will be described in greater detail below, fuel/air mixing disk 85 provides more premix turbulence within main fuel mixer 88 than the prior art swirler vanes 80 described above. The increased premix turbulence results in a more evenly distributed fuel/air mixture and, consequently, reduced $NO_x$ and CO emissions.

Compressed air 12 enters pilot flame zone 23 through a set of stationary turning vanes 10 located inside pilot swirler 11. Compressed air 12 mixes with pilot fuel 30 within pilot cone 20 and is carried into pilot flame zone 23 where it combusts.

Figure 1:
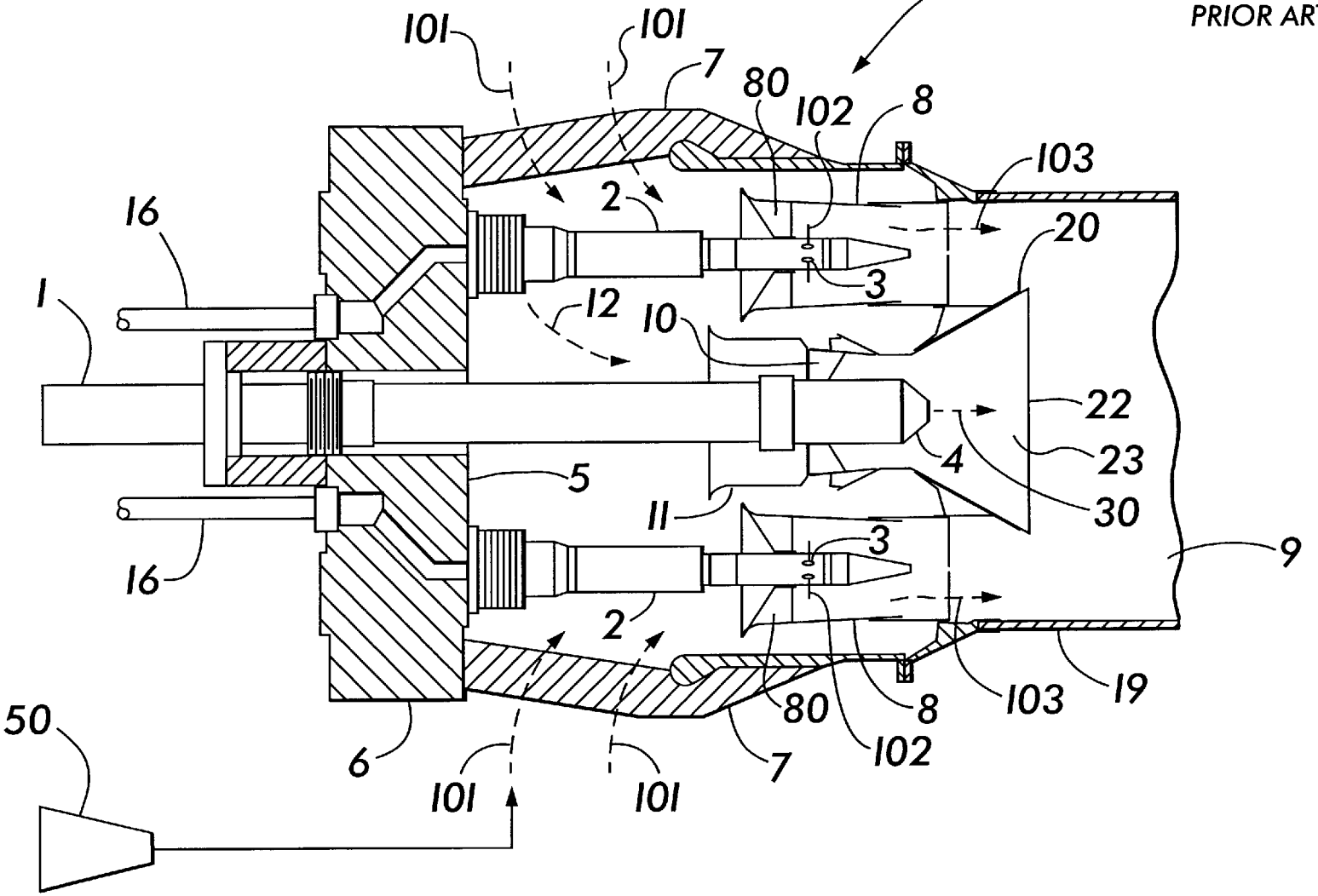
FIG. 1 PRIOR ART
FIG. 1 shows a cross-sectional view of a prior art gas turbine combustor.
Figure 2:
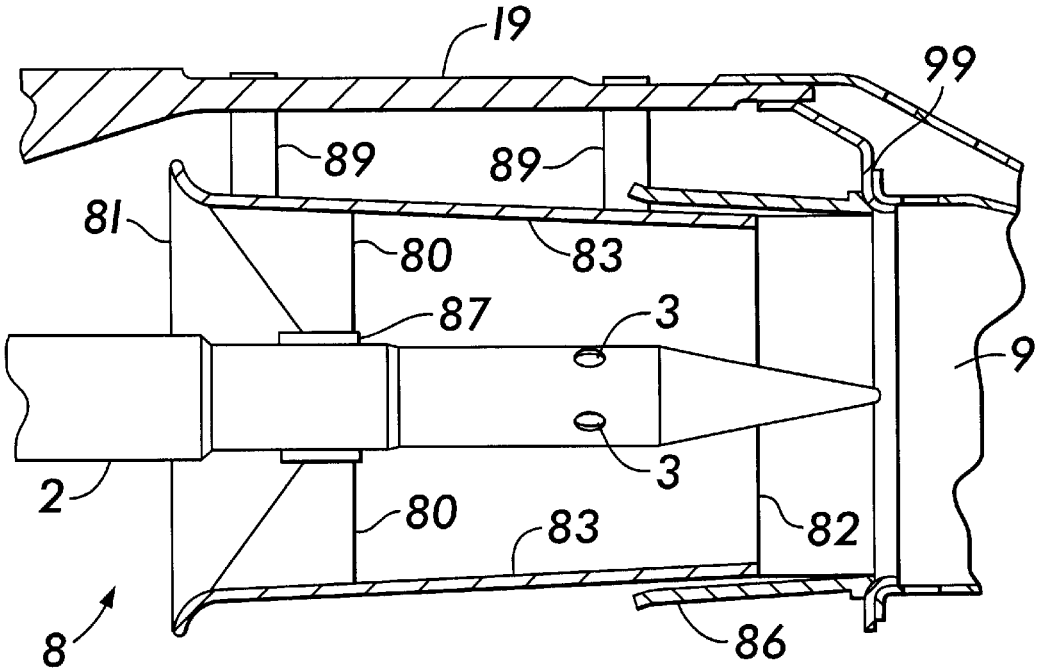
FIG.2 PRIOR ART
FIG. 2 shows a cross-sectional view of a prior art fuel swirler.
Figure 5:
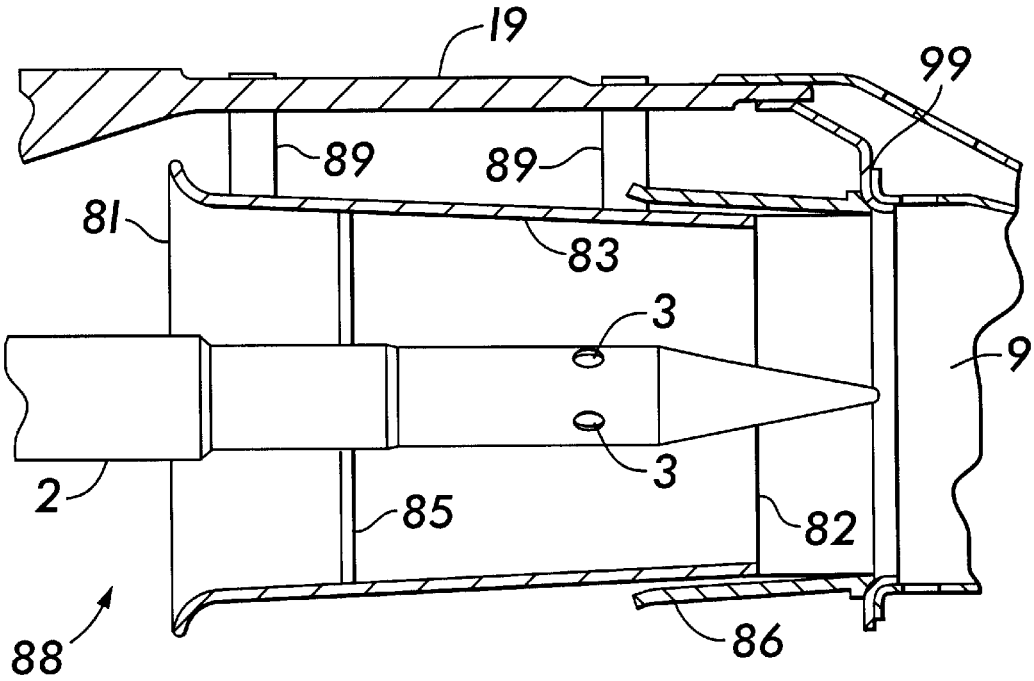
FIG. 5 shows a cross sectional view of a preferred embodiment of a fuel mixer comprising fuel/air mixing disks according to the present invention.
Figure 3:
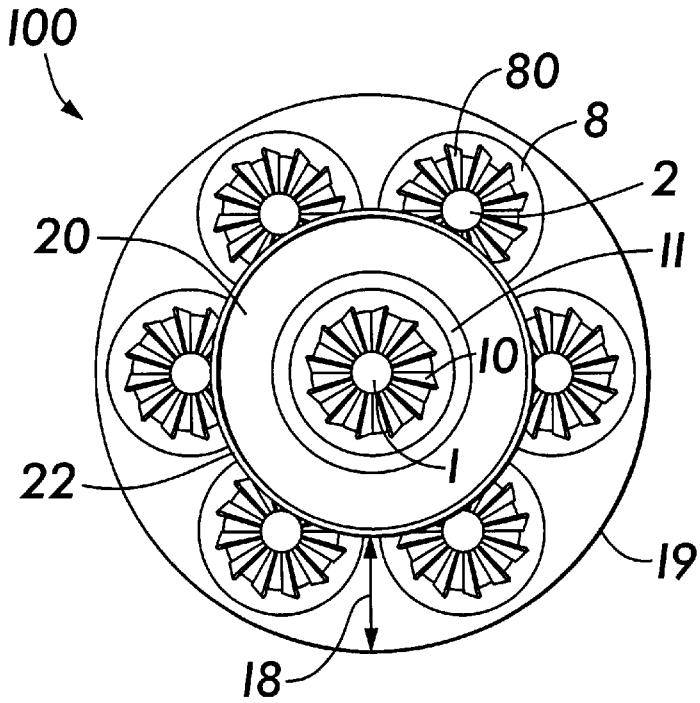
FIG. 3 PRIOR ART
FIG. 3 shows an upstream view of a prior art gas turbine combustor.

FIG. 5 shows a cross sectional view of a preferred embodiment of a fuel mixer 88 comprising fuel/air mixing disks 85 according to the present invention. As shown in FIG. 5, fuel mixer 88 is substantially cylindrical in shape, having a flared end 81 and a tapered end 82. A fuel/air mixing disk 85 is coaxially disposed within fuel mixer 88 proximate flared end 81. Fuel mixer 88 surrounds main fuel nozzle 2 proximate main fuel injection ports 3. Fuel mixer 88 is positioned with fuel/air mixing disk 85 upstream of main fuel injection ports 3 and tapered end 82 adjacent to main combustion zone 9. Flared end 81 is adapted to receive compressed air 101 and channel it into fuel mixer 88. Tapered end 82 is adapted to fit into sleeve 86. Fuel/air mixing disk 85 is attached to the inner perimeter 83 of main fuel mixer 88. Fuel/air mixing disk 86 surrounds main fuel nozzle 2. Fuel mixer 88 is attached to liner 19 via attachments 89 and swirler base 99.

Figure 6:
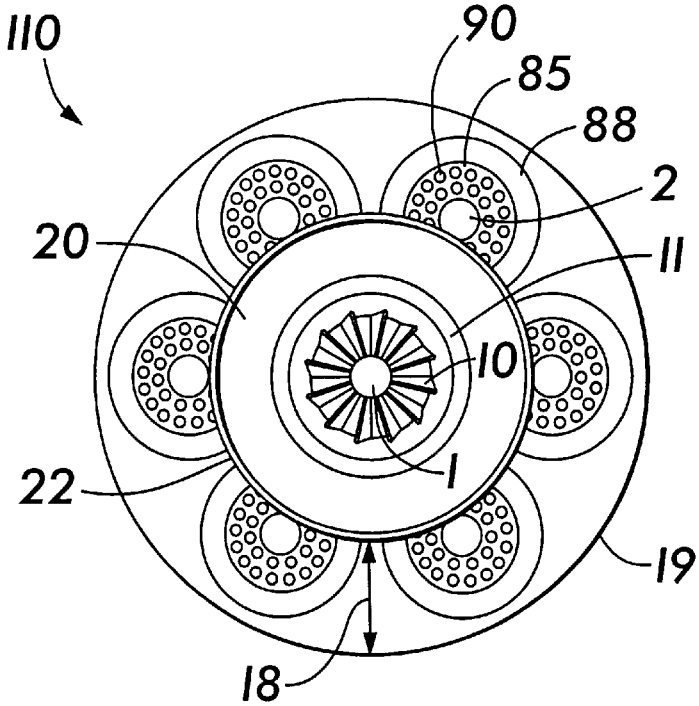
FIG. 6 shows an upstream view of a preferred embodiment of a gas turbine combustor comprising fuel/air mixing disks according to the present invention.

FIG. 6 shows an upstream view of a preferred embodiment of a gas turbine combustor comprising fuel/air mixing disks according to the present invention. As shown in FIG. 6, pilot nozzle 1 is surrounded by pilot swirler 11. Pilot swirler 11 has a plurality of stationary turning vanes 10. Pilot nozzle 1 is surrounded by a plurality of main fuel nozzles 2. A main fuel mixer 88 surrounds each main fuel nozzle 2. The diverged end 22 of pilot cone 20 forms an annulus 18 with liner 19. Main fuel mixers 88 are upstream of diverged end 22. Fuel/air mixture 108 flows through annulus 18 (out of the page) into main combustion zone 9 (not shown in FIG. 6).

According to the present invention, each main fuel mixer 88 comprises a fuel/air mixing disk 85. Each fuel/air mixing disk 85 has a plurality of holes 90 disposed throughout the disk 85 as shown. The number and size of holes 90 dictate the pressure drop that will be obtained within fuel mixer 88. By varying the number and size of holes 90, the pressure drop can be varied to optimize the pressure drop to increase premix turbulence without increasing the risk of flame holding or flashback. Unlike prior art swirler vanes 80, however, fuel/air mixing disks 85 are very inexpensive to make. Consequently, during optimization, the number and size of holes 90 can be varied until the pressure drop is optimized. Similarly, for different sized combustors, the overall surface area of fuel/air mixing disk 85 can be adjusted easily and inexpensively, and the number of and size of holes 90 varied once again until the pressure drop is optimized. Thus, fuel/air mixing disks 85 enable a fuel mixer 88 that reduces $NO_x$ and CO emissions from gas turbine combustors 110 by optimizing the amount of premix turbulence generated to provide more evenly distributed fuel/air mixtures without increasing the risk of flame holding or flashback. Moreover, fuel/air mixing disks 85 enable a fuel mixer 88 that reduces $NO_x$ and CO emissions from gas turbine combustors by providing greater control over the pressure drop within the fuel mixer, while increasing the flexibility and decreasing the costs associated with optimizing the AFR in combustors of different sizes.

Those skilled in the art will appreciate that numerous changes and modifications may be made to the preferred embodiments of the invention and that such changes and modifications may be made without departing from the spirit of the invention. It is therefore intended that the appended claims cover all such equivalent variations as fall within the true spirit and scope of the invention.

What is claimed is:

1. A fuel mixer for mixing compressed air and fuel in a gas turbine combustor, said fuel mixer comprising:

a substantially cylindrical body having an axis, a flared end, and a tapered end, the flared end adapted for receiving said compressed air and for channeling said compressed air into said fuel mixer; and an air mixing disk having a disk axis, said air mixing disk disposed within said body proximate the flared end thereof upstream of a fuel injection port, the disk axis substantially parallel to the axis of said body, said air mixing disk having a plurality of holes parallel to the disk axis.

2. A gas turbine combustor, comprising:

a nozzle housing having a nozzle housing base, a main combustion zone located adjacent to said nozzle housing;

a diffusion fuel pilot nozzle having a pilot fuel injection port, disposed on an axial centerline of said gas turbine combustor upstream of the main combustion zone, said pilot nozzle extending through said nozzle housing and attached to the nozzle housing base;

a pilot cone projecting from the vicinity of the pilot fuel injection port of said pilot nozzle, said pilot cone having a diverged end adjacent to the main combustion zone, said pilot cone forming a pilot flame zone adjacent to the main combustion zone;

at least one main nozzle parallel to said pilot nozzle, said main nozzle extending through said nozzle housing and attached to the nozzle housing base; and at least one fuel mixer parallel to said pilot nozzle and adjacent to the main combustion zone, said fuel mixer surrounding said main nozzle, said fuel mixer comprising an air mixing disk positioned upstream of a fuel injection port on said main nozzle.

3. The gas turbine combustor of claim 2, wherein said fuel mixer has a substantially cylindrical body having an axis, a flared end, and a tapered end, the flared end adapted for receiving compressed air and for channeling said compressed air into said fuel mixer; and said air mixing disk has a disk axis, said air mixing disk disposed within said body proximate the flared end thereof, the disk axis substantially parallel to the axis of said body, said air mixing disk having a plurality of holes parallel to the disk axis.

4. The gas turbine combustor of claim 2 wherein the diffusion fuel pilot nozzle further comprises stationary swirl vanes.

5. A gas turbine, comprising:

a) a compressor for compressing air;

b) a gas turbine combustor for producing a hot gas by burning a fuel in said compressed air, comprising:

i) a nozzle housing having a nozzle housing base, a main combustion zone located adjacent to said nozzle housing;

ii) a diffusion fuel pilot nozzle having a pilot fuel injection port, disposed on an axial centerline of said gas turbine combustor upstream of the main combustion zone, said pilot nozzle extending through said nozzle housing and attached to the nozzle housing base;

iii) a pilot cone projecting from the vicinity of the pilot fuel injection port of said pilot nozzle, said pilot cone having a diverged end adjacent to the main combustion zone, said pilot cone forming a pilot flame zone adjacent to the main combustion zone;

iv) at least one main nozzle parallel to said pilot nozzle, said main nozzle extending through said nozzle housing and attached to the nozzle housing base; and v) at least one fuel mixer parallel to said pilot nozzle and adjacent to the main combustion zone, said fuel mixer surrounding said main nozzle, said fuel mixer comprising an air mixing disk positioned upstream of a fuel injection port on said main nozzle; and c) a turbine for expanding the hot gas produced by said gas turbine combustor.

6. The gas turbine of claim 5, wherein said fuel mixer has a substantially cylindrical body having an axis, a flared end, and a tapered end, the flared end adapted for receiving compressed air and for channeling said compressed air into said fuel mixer; and said air mixing disk has a disk axis, said air mixing disk disposed within said body proximate the flared end thereof, the disk axis substantially parallel to the axis of said body, said air mixing disk having a plurality of holes parallel to the disk axis.

7. The gas turbine of claim 5 wherein the diffusion fuel pilot nozzle further comprises stationary swirl vanes.

* * * * *